United States Patent [19]

Adler et al.

[11] Patent Number: 4,902,257

[45] Date of Patent: Feb. 20, 1990

[54] METHODS AND APPARATUS FOR MAKING FLAT TENSION MASK COLOR CATHODE RAY TUBES

[75] Inventors: Robert Adler, Northfield; James R. Fendley, Arlington Heights; Howard G. Lange, Prospect Heights; Charles J. Prazak, III, Elmhurst; Johan Steiner, Des Plaines; Paul Strauss, Chicago, all of Ill.

[73] Assignee: Zenith Electronics Corporation, Glenview, Ill.

[21] Appl. No.: 223,475

[22] Filed: Jul. 22, 1988

[51] Int. Cl.[4] ..... H01J 9/20

[52] U.S. Cl. ..... 445/4; 445/30; 445/68

[58] Field of Search ..... 445/3, 4, 30, 63, 64, 445/68

[56] References Cited

U.S. PATENT DOCUMENTS

| | | | |
|---|---|---|---|
| 2,625,734 | 1/1953 | Law | 445/4 |
| 2,689,779 | 9/1954 | Grimm et al. | 445/64 |
| 2,733,366 | 1/1956 | Grimm et al. . | |
| 3,437,482 | 4/1969 | Yamada et al. . | |
| 3,451,812 | 6/1969 | Tamura . | |
| 3,494,267 | 2/1970 | Schwartz . | |
| 3,563,737 | 2/1971 | Jonkers . | |
| 3,638,063 | 1/1971 | Tachikawa et al. . | |
| 3,676,914 | 7/1972 | Fiore . | |
| 3,768,385 | 10/1973 | Noguchi . | |
| 3,889,329 | 6/1975 | Fazlin | 445/30 |
| 3,894,321 | 7/1975 | Moore | 313/482 |
| 3,983,613 | 10/1976 | Palac et al. . | |
| 3,989,524 | 11/1976 | Kazimir Palac . | |
| 4,069,567 | 1/1978 | Schwartz | 445/30 |
| 4,593,224 | 6/1986 | Palac | 313/407 |
| 4,692,660 | 9/1987 | Adler et al. . | |
| 4,695,761 | 9/1987 | Fendley | 313/407 |
| 4,758,728 | 7/1988 | Matey et al. | 445/63 X |

FOREIGN PATENT DOCUMENTS

| | | | |
|---|---|---|---|
| 1477706 | 3/1967 | France . | |
| 142730 | 8/1983 | Japan | 445/3 |
| 237340 | 10/1986 | Japan | 445/30 |
| 2052148 | 6/1979 | United Kingdom . | |

OTHER PUBLICATIONS

"Improvements in the RCA Three-Beam Shadow--Mask Color Kinescope" by Grimes et al., pp. 315-326.

*Primary Examiner*—Kenneth J. Ramsey

[57] ABSTRACT

This disclosure describes method and apparatus useful in the manufacture of shadow mask color cathode ray tubes of the flat tension mask type, wherein the shadow masks and associated glass front panels are respectively interchangeable during mask-panel assembly.

35 Claims, 6 Drawing Sheets

METHODS AND APPARATUS FOR MAKING FLAT TENSION MASK COLOR CATHODE RAY TUBES

BACKGROUND OF THE INVENTION

Field of the Invention

The invention applies to the manufacture of flat tension mask color cathode ray tubes. More specifically, the invention provides means for achieving registration of the aperture patterns of flat tension shadow masks and related cathodoluminescent screens.

In particular, the invention relates to a portion of the process steps employed in the manufacture of the front glass panel assembly of a flat tension mask color cathode ray tube. The front glass panel assembly includes a glass front panel, a support structure on the inner surface of the front glass panel and a tensed foil shadow mask affixed to the support structure.

Cross Reference to Related Application

This application is related to, but in no way dependent upon, application Ser. No. 058,095, filed 6-4-87 now U.S. Pat. No. 4,828,523.

Problems in the Conventional Manufacturing Process

Historically, color cathode ray tubes have been manufactured by requiring that a shadow mask dedicated to a particular panel follow the panel through various stages of the manufacturing process. Such a procedure is more complex than might be obvious; a complex conveyer system is needed to maintain the marriage of each mask assembly to its associated panel throughout the manufacturing process. In several stages of the process the panel must be separated from the mask, and the mating shadow mask cataloged for later reunion with its panel mate.

With the recent commercial introduction of the flat tension mask cathode ray tube, many process problems related to the curvature of the mask and panel have been alleviated or reduced. Necessarily, however, initial production of flat tension mask tubes has been based on continued use of the proven technology of mating a dedicated mask to a specific front glass panel throughout the manufacturing process. However, because the flat tension mask requires tension forces during the manufacturing process as well as after installation in a tube, somewhat cumbersome in-process support frames become necessary. These introduce complexity and expense in the manufacture of color cathode ray tubes of the tension mask type.

Thus the desirability of simplifying the conventional production process remains as great as ever in the manufacture of cathode ray tubes of the flat tension mask type.

It has been recognized that color tube manufacture would be simplified if any mask could be registered with any screen (commonly termed an "interchangeable" mask), so that masks and screens would no longer have to be individually mated. Yet to this day, no commercially viable approach suitable for achieving such component interchangeability has been implemented or disclosed.

| Known Prior Art | |
|---|---|
| 2,625,734 | Law |

-continued

| Known Prior Art | |
|---|---|
| 2,733,366 | Grimm |
| 3,437,482 | Yamada et al |
| 3,451,812 | Tamura |
| 3,494,267 | Schwartz |
| 3,563,737 | Jonkers |
| 3,638,063 | Tachikawa |
| 3,676,914 | Fiore |
| 3,768,385 | Noguchi |
| 3,889,329 | Fazlin |
| 3,894,321 | Moore |
| 3,983,613 | Palac |
| 3,989,524 | Palac |
| 4,593,224 | Palac |
| 4,692,660 | Adler |
| 4,695,761 | Fendley |
| FR1,477,706 | Gobain |
| GB2,052,148 | Sony |
| 20853/65 | Japanese |

Article "Improvements in the RCA Three Beam Shadow-Mask Color Kinescope", Grimes, 1954, Proceedings of the IRE, January, 1954, pgs. 315–326.

Objects of the Invention

It is an object of this invention to provide manufacturing apparatus and process for color cathode ray tubes of the flat tension mask type wherein shadow masks and front panels are respectively interchangeable during mask-panel assembly.

It is also an object of the invention to provide a method for achieving practical interchangability of shadow masks in the manufacture of flat tension mask color cathode ray tubes by providing automatic means for adjusting the position size and/or shape of a mask such that its aperture pattern is brought into registration with a standard pattern.

It is an object of this invention to provide, in a manufacturing process for color cathode ray tubes of the flat tension mask type wherein shadow masks and front panels are respectively interchangeable during mask-panel assembly, a method and associated apparatus for changing a geometrical parameter of the mask pattern to achieve coincidence with a standard pattern which bears a fixed geometrical relationship to a predetermined screen pattern.

It is a further object of the invention to provide means of mating the mask to a support structure such that mask pattern and screen pattern are in registry.

It is another object of the invention to provide position sensing means and a feedback control system for applying controlled forces at a plurality of locations about the periphery of the mask for the purpose of moving the mask to a desired position and stretching it to a desired size and shape.

DESCRIPTION OF THE PREFERRED EMBODIMENT

Apparatus according to the invention is for use in the manufacture of a color cathode ray tube having a shadow mask with a central pattern of apertures mounted in tension on a transparent flat front panel. The mask aperture pattern is in registration with a corresponding cathodoluminscent screen pattern on an inner surface of the panel. The front panel has mask support means secured to the screen-bearing inner surface of the panel along opposed edges of the screen pattern. The shadow masks and front panels are respectively interchangeable, according to the invention.

The apparatus essentially comprises optical screen reference means associated with a screen pattern on a front panel and indicative of the size or shape of the screen pattern. Optical mask reference means are associated with a mask aperture pattern on a shadow mask and indicative of the size or shape of the mask pattern. Means are provided for altering the size or shape of one of the patterns relative to the other. Control means including a feedback system is responsive to the mask reference means and the screen reference means and thus the size or shape relationship of said screen pattern and said mask pattern. The control means provide for controlling the expansion so that the mask reference means attains optical alignment with the screen reference means indicative of correspondence in size or shape between the mask and screen patterns in the geometric parameter. The apparatus includes means for securing the mask to the mask support means on the front panel with the mask and screen patterns in registration.

Figure 1:
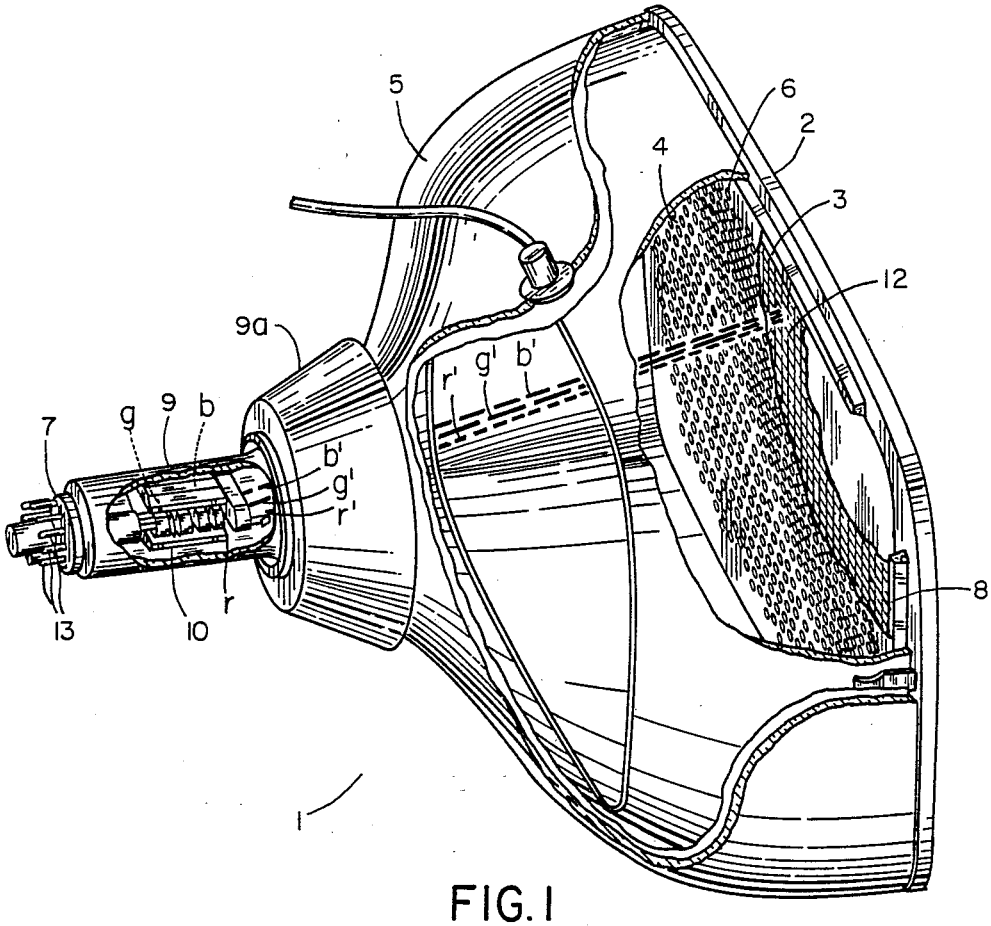
FIG. 1 illustrates a flat tension mask tube of the type with which this invention may be employed.

FIG. 1 depicts a flat tension mask color cathode ray tube 1 including a glass front panel 2 hermetically sealed to an evacuated envelope 5 extending to a neck 9 and terminating in a connection plug 7 having a plurality of stem pins 13.

Internal parts include a mask support structure 3 permanently attached to the inner surface 8 of the panel 2 which supports a tension shadow mask 4. The mask support structure 3 is machine ground to provide a planar surface at fixed "Q" distance from the plane of the inner surface 8. On the inner surface 8 of the panel 2 is deposited a screen 12 comprising a black grille and a pattern of colored light emitting phosphors distributed across the expanse of the inner surface 8 within the inner boundaries of the support structure 3. The phosphors 12, when excited by the impingement of an electron beam, emit red, green and blue colored light.

The shadow mask 4 has a large number of beam-passing apertures 6 and is permanently affixed, as by laser welding, to the ground surface of the support structure 3.

In the neck 9 of the tube 1 is installed a cluster 10 of three electron guns identified as r, g and b. The electron guns emit three separate electron beams designated as r′,g′ and b′ directed toward the mask 4. The electron beams are electronically modulated in accordance with color picture signal information. Deflected by magnetic fields produced by a yoke 9*a* external to the tube, the electron beams r′, g′, and b′ are caused to scan horizontally and vertically such that the entire surface of the mask 4 is swept in a periodic fashion to form an image extending over substantially the entire area of the screen 12 within the inner boundaries of the mask support structure 3.

At positions on the mask 4 where there is an aperture 6, each of the three electron beam passes through the mask and impinges on the screen 12. Thus, the position of the mask 4 with its pattern of apertures 6, the positions of the electron guns r, g and b at 10, and the height of the support structure 3 control the locations where the electron beams r′,g′ and b′ impinge on the screen 12.

For proper operation of the tube 1, there must be on the screen 12, a light emitting phosphor deposit of the proper color characteristic corresponding to the color information of the impinging electron beam r′, g′ or b′. Further, for proper operation, the center of the area of impingement of the electron beam must coincide within a narrow tolerance with the center of the associated phosphor deposit.

When these conditions are met over the entire surface of the screen, then mask and screen are said to be registered.

The rectangular area within which images are displayed, i.e. the area covered by the electron beams on the screen, is larger than the corresponding area on the mask through which those electron beams pass; the linear magnification from mask to screen is of the order of a few percent. Detailed studies have shown that this magnification varies slightly across the screen. Therefore, when a phrase such as "registration between mask and screen patterns" or "registration between the aperture pattern of the mask and the screen pattern" is used in this specification, it does not mean that the two patterns are congruent like a photographic negative and its contact print. Rather, it means that the two patterns are related to each other as required in a color tube of the flat construction described, using a support structure of predetermined height and having a predetermined spacing from mask to screen. Such registration of mask and screen is with respect to the electron beam center of deflection. As noted, in color tubes of conventional construction, registration is facilitated by using pairing dedicated shadow masks and front panels.

Conventional shadow masks are produced by photoetching the apertures in a flat metal sheet, then deforming the flat sheet into a bowl shape. After this deformation process, the formed masks are not interchangeable. However, with a mask that remains flat, the original interchangeability of flat sheets photoetched from a common master is retained. This is an important factor in the method and apparatus hereinafter described.

In a flat tension mask tube, the tension mask is typically made of steel foil about 0.001 inch thick. The mask is under substantial mechanical tension; the stress may be between 30,000 and 50,000 pounds per square inch. The mask is therefore stretched to a significant degree, the elastic deformation exceeding one part in one thousand, e.g. the conventional flat tension mask manufacturing method puts each mask into an elastically deformed condition before producing, by photolithography, the screen which will be used with that mask.

The present invention, on the other hand, calls for all screens to be made from a common master so that they are interchangeable. It also recognizes that the unstretched masks, as mentioned earlier, are very nearly alike, and it takes advantage of the elastic deformation of a mask that occurs when a mask is stretched. By applying controlled forces to a plurality of clamps gripping peripheral portions of the mask, each mask may be stretched in such a manner that its size and shape conform to a predetermined standard. If desired, the required forces may be substantially reduced by heating the mask during the stretching process.

The same clamps and forces also permit centering of the mask by moving it along its x and y axes (the major and minor dimensions in the plane of the mask), and by rotating it if need be, until multiple reference marks on the mask are aligned with corresponding fixed markers to indicate that position, size and shape of the mask now conform to a predetermined standard. Once this is achieved, a panel carrying a standardized screen and the mask are registered, in a manner to be described, with the mask contacting the mask support structure. The mask is then affixed to the mask support structure, as by laser welding.

Figure 2:
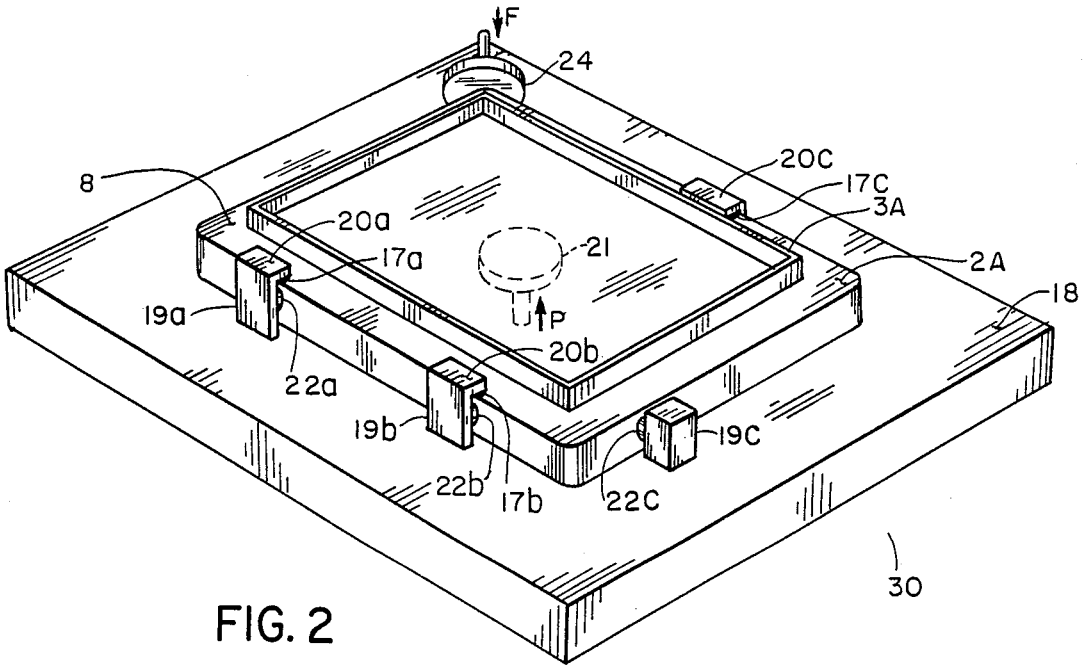
FIG. 2 illustrates a universal holding fixture useful in the practice of the present invention.

FIG. 2 describes a six-point universal holding fixture 30 for glass front panel assemblies to be used during all manufacturing processes requiring reproducible positioning of a panel 2A in reference to an established set of datum coordinates. Panel 2A, carrying mask support structure 3A, is shown on a fixture plate 18 using a holding method comprising three half-ball locators **22*a*, 22*b*, 22*c*, attached to posts designated as 19*a*, 19*b* and 19*c*, to control lateral position, while three vertical stops 20*a*, 20*b* and 20*c* control vertical position. Vertical stops 20*a*, 20*b* and 20*c* are provided with firm but relatively soft contact surfaces 17*a*, 17*b* and 17*c* made of a material such as Delrin (TM) to protect the inner surface of panel 2A. A pressure device 21, shown in phantom lines below panel 2A, exerts an upward vertical force P to assure firm contact between the inner surface and the three vertical stops 20*a*, 20*b*, 20*c*. A second pressure device 24, exerting a horizontal force F in the direction toward the corner between posts 19*b* and 19*c*, assures firm contact between the panel 2A and the three half-balls, 22*a*, 22*b*, 22*c***.

Vertical stops **20*a* and 20*b* are co-located with posts 19*a* and 19*b*, but the third vertical stop 20*c* is completely separated from post 19*c***.

Figure 3:
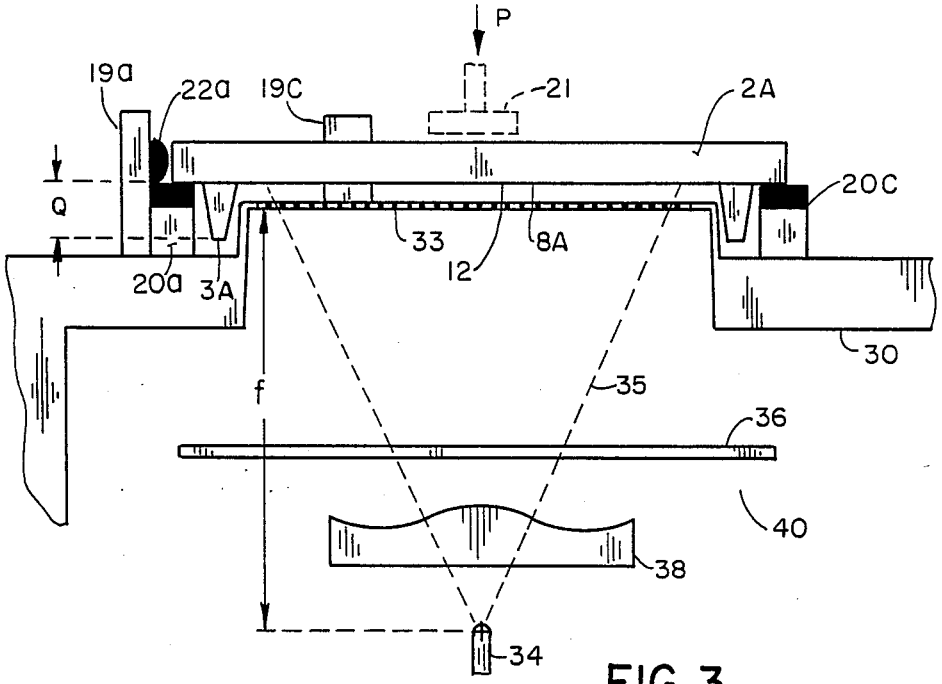
FIG. 3 is a modified version of the universal holding fixture depicted in FIG. 2, adapted for use with a lighthouse.

By controlling within close limits the position of the three half-ball locators **22*a*, 22*b*, 22*c*, as well as the plane defined by the three vertical stops 20*a*, 20*b*, and 20*c* in different work stations in the manufacturing process, the position of a given panel in each of such work stations may be accurately duplicated. FIG. 3 illustrates a modification of the universal holding fixture 30 adapted to a lighthouse 40. It will be noted that panel 2A and vertical stops, two of which are depicted (20*a*, and 20*c*,) have been inverted while posts, two of which are depicted at 19*a* and 19*c*, remain upright to allow insertion of panel 2A from above. Pressure device 21 is optional in this modification, since the weight of panel 2A** may suffice to ensure proper seating on the vertical stops.

As is well known in the art of manufacturing color cathode ray tubes, a lighthouse is used for photo-exposing light-sensitive materials applied to the inner surface 8A of a panel 2A. Four separate exposures in four different lighthouses are needed to produce the black background pattern and the three separate colored light emitting phosphor patterns which comprise the screen 12. Photoexposure master 33 is permanently installed in lighthouse 40, with the image-carrying layer facing upward and spaced a very small distance (0.010", e.g.) from the inner surface of panel 2A. At a fixed distance "f" from the plane of the photoexposure master 33 is placed an ultraviolet light source 34 which emits light rays 35 which simulate the electron beam paths in a completed tube.

A shader plate 36 modifies the light intensity over the surface of the mask so as to compensate for the variation of distance from the light source and for the variation of the angle of incidence, thereby achieving the desired exposure in all regions. Lens 38 provides for correction of the paths of the light rays so as to simulate more perfectly the trajectories of the electron beams during tube operation.

Experience has indicated that screen patterns produced by following the procedures just described are sufficiently accurate for use in high resolution tubes, provided that the Q height of support structure 3A, measured from the inner surface 8A of panel 2A to the machine ground top surface of the support structure, is held to a very close tolerance.

Figure 4:
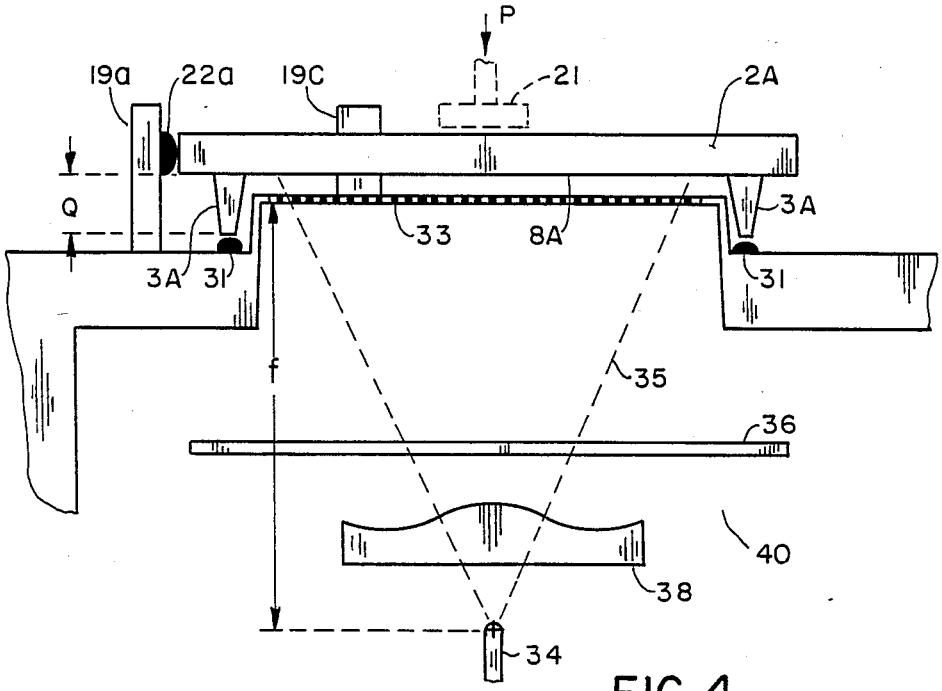
FIG. 4 is a modification of the apparatus depicted in FIG. 3 which accommodates a wider tolerance in the Q height of the mask support structure.

A modification of FIG. 3, depicted in FIG. 4, accommodates a wider tolerance in the Q height of the mask support structure. Here the vertical stops are replaced by half-balls 31, and the panel 2A rests, not on its inner surface, but on the ground top surface of support structure 3A. If, for example, that structure on a given panel is 0.002" too high, that panel sits that much higher during exposure, and the light pattern recorded on it is larger than normal. This is exactly what is required; when a mask is eventually affixed to this support structure, it will be 0.002" farther away from the panel, causing the electron beams also to form a larger pattern and thus compensate for the excess vertical height Q. In effect, then, an interchangeable screen is produced in spite of the 0.002" error in support structure height Q.

The process for producing the screen pattern described in connection with FIGS. 3 and 4 differs from the conventional process in that for each of the four photo exposures, a permanent master is used rather than an individual mask uniquely associated with a particular screen. However, because this invention makes it unnecessary to match each screen to a particular mask, other more economical processes may be used to manufacture the screen pattern. Well known printing processes such as, for example, offset printing are particularly well adapted to producing the required precise screen pattern on flat glass plates. The important aspect of using offset printing is that four separate processes of photo exposure, development and drying, followed by coating for the next process, are no longer required. In effect, offset printing offers the possibility of inexpensively producing an interchangeable screen pattern as required by this invention.

If offset printing or a similar process is employed, the height Q of support structure 3A must be controlled to an accuracy appropriate to the special requirements of the application.

Figure 5:
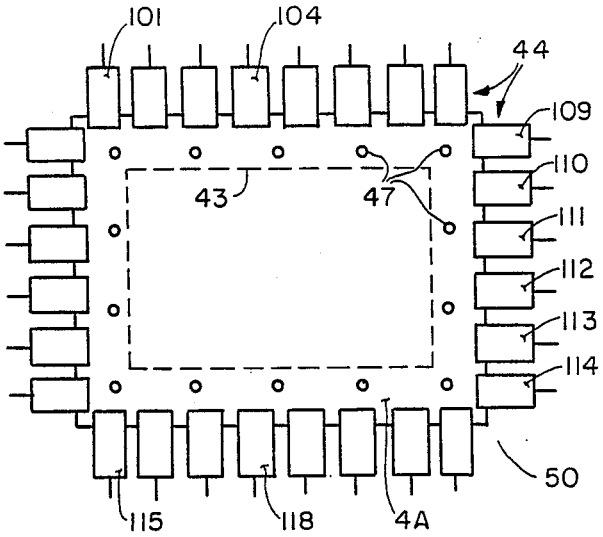
FIG. 5 schematically illustrates a machine for adjusting the size, position, and/or shape of a shadow mask in accordance with the principles of this invention.

FIG. 5 depicts schematically a machine 50 for applying controlled forces to a plurality of clamps gripping peripheral portions of the mask, capable of moving and elastically deforming the mask until its position, size and shape conform to a predetermined standard. The machine is also equipped to move a screened panel into a specified position adjacent to the mask and to weld the mask to the support structure; these features, not shown in FIG. 5, will be described in detail later.

FIG. 5 depicts a rectangular, in-process shadow mask 4A having a wide peripheral portion. This is the form in which the mask emerges from the photoetching process. The central apertured region of the mask is bounded by rectangle 43. Outside this rectangle and surrounding it there is a row of widely spaced position-sensing apertures 47. Optical markers attached to machine 50, to be described in detail later, serve as position references and present in this embodiment, the afore-discussed predetermined standard. It is the task of machine 50 to apply a distribution of forces to the mask such as to bring all apertures 47 into coincidence with their corresponding optical markers.

Located around the periphery of mask 4A is an array of clamps 44 which may each comprise a pair of actuatable jaws. For purposes of illustration, twenty eight clamps are depicted. The reason for having a plurality of clamps on each side is that the individual clamps must be free to move apart as needed when the mask is stretched. The same plurality also permits application of a desired distribution of forces about the periphery of the mask 4A.

It must be kept in mind that the apertured central region of the mask inside rectangle 43 has an average elastic stiffness considerably smaller than that of the solid peripheral portion. Since it is desirable in the stretching process to essentially maintain the rectangular configuration of the central apertured region, stretching forces must be graded, with the magnitude of each force related to the local elastic stiffness encountered at each clamp 44. For example, the opposing clamps 101 and 115 act on solid material at one end of the mask; they therefore require considerably greater force than opposing clamps 104 and 118 which act on a portion containing largely apertured material.

Figure 6:
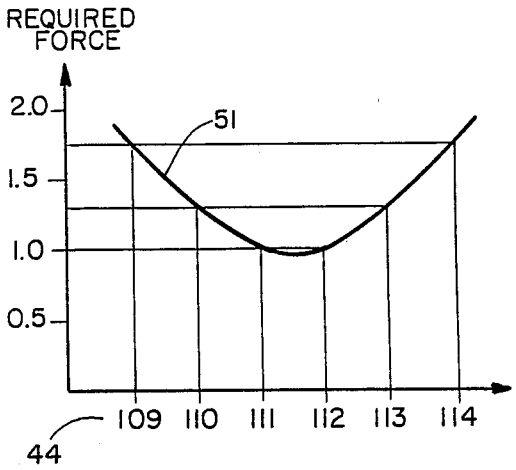
FIG. 6 is a curve representing the distribution of required forces along one edge of a shadow mask.

FIG. 6 depicts a curve 51 representing the distribution of required force along one edge of mask 4A. It is seen that the force required near the corners is about 70% higher than that near the center.

In principle, it would be possible to control the forces applied to a large number of clamps, say twenty-eight as in FIG. 5, individually. But in practice, mass-produced masks are very much alike and there is no need for such a large number of independently variable forces. In fact, if the photoetched masks were exactly alike in thickness, elastic properties and detailed geometry, the forces to be applied to them to obtain a standard shape would always be the same. Such forces could be preprogrammed, and no feedback would be required.

In practice there are unavoidable variations in thickness, between masks as a whole as well as across each mask, and there may be slight variations in geometry caused, for example, by temperature variation during manufacture. To compensate for these variations, some force adjustments are necessary, and these are controlled by feedback according to this invention.

It is evident that the number of independent adjustments required in a specific case depends on the accuracy with which the masks are manufactured, and on the tolerance required for the particular tube design. In an extreme case where tolerances are fairly wide, thickness variation between different lots of masks may be the only significant variation. In this case only two independent adjustments, namely the total forces applied in the x and y directions, need to be controlled by feedback. The distribution 51 of applied forces within each coordinate axis may then be achieved by purely mechanical means such as, for example, a system of levers.

Figure 7:
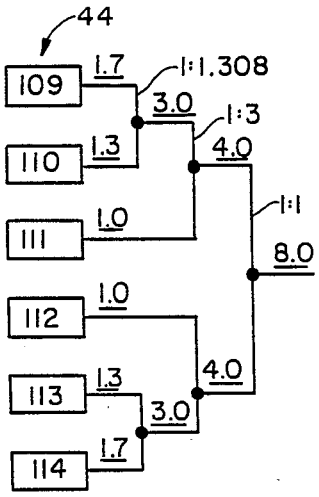
FIG. 7 illustrates the use of levers to distributed forces along edges of a mask.

FIG. 7 illustrates the use of levers to distribute forces according to predetermined ratios. The figure shows six clamps labeled 109–114, assumed to be attached to one of the short edges of the mask. The desired forces, in arbitrary units, are, in this example: 1.7, 1.3, 1, 1, 1.3, 1.7. Forces along the pull rods are underlined in the figure; the figures associated with the levers indicate lever ratios. It is seen that any desired ratio of forces for any desired number of clamps along one edge can be so generated.

Figure 8A:
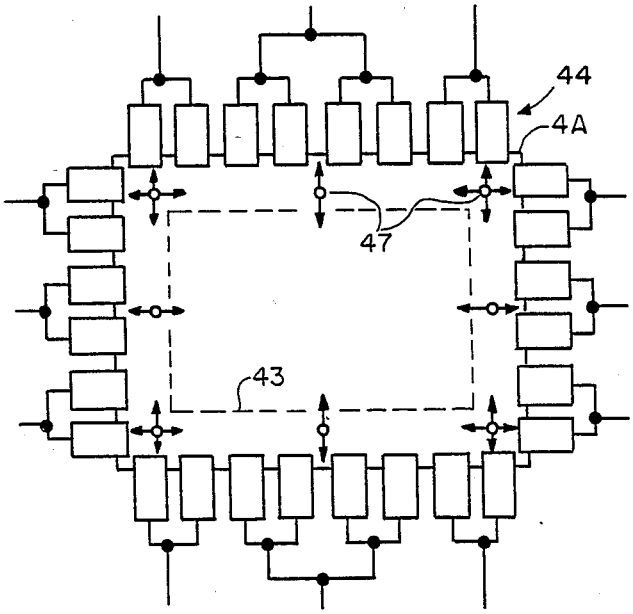
FIG. 8*a* depicts a modification of a FIG. 5 apparatus having a reduced number of independently variable applied forces.

FIG. 8A illustrates a modification of FIG. 5, where there are still 28 clamps but only eight position sensing apertures 47, and a total of twelve independently variable forces. Adjacent clamps are interconnected by levers as just explained, with the result that there are just three independent forces along each side. The four position sensing apertures located in the corners are designed to detect position errors along both the x and y axes; those four apertures positioned near the center of each side respond only to radial, i.e. inward or outward displacements. Thus the total number of position error signals is twelve, equal to the number of independently controllable forces.

In addition to applying forces which act at right angles to the edges of the mask, it may sometimes be desirable to apply tangential forces in a direction parallel to an edge. FIG. **8*b* illustrates such an arrangement, using as an example a tension mask in which apertures 406 within boundary 443** are parallel slots rather than round holes. Slot masks are commonly used in color cathode ray tubes intended for television receivers. The slots conventionally run along the vertical (y) direction; they are not continuous from top to bottom, but are bridged at regular intervals by tie-bars to increase the mechanical stability of the mask.

In a color cathode ray tube of the flat tension mask type, a similar pattern of apertures, i.e. slots parallel to the y-axis, bridged at regular intervals, may be used. Only the x-coordinate of the mask pattern need register with the screen pattern, assuming the phosphor stripes are continuous. Parallel to the slots, along the y-axis, high mechanical tension is applied; the amount of this tension is not critical so long as the elastic limit of the mask material is not exceeded. Along the x-axis, a carefully controlled amount of tension is applied; because the mechanical stiffness of he delicate bridges (not shown) is rather small, the tension in this direction must also be low.

Machine 450 in FIG. **8*b* is designed to apply controlled forces, including tangential forces, to a slot mask 404. Along the two vertical edges, clamps 444** are pulled outwardly by forces acting at right angles to those edges. The four clamps located near the middle of each edge are interconnected by levers. Six independently controllable forces $F_1$ through $F_6$ are applied to these two edges.

Turning now to the two horizontal edges, predetermined forces $F_0$ which need not be controlled by feedback are applied at right angles to these edges near the four corners of the mask. However, the two middle clamps on each horizontal edge are pulled generally outward by forces $F_R(1)$, $F_R(2)$ which are not perpendicular to the edge but have a controllable tangential component.

Figure 8B:
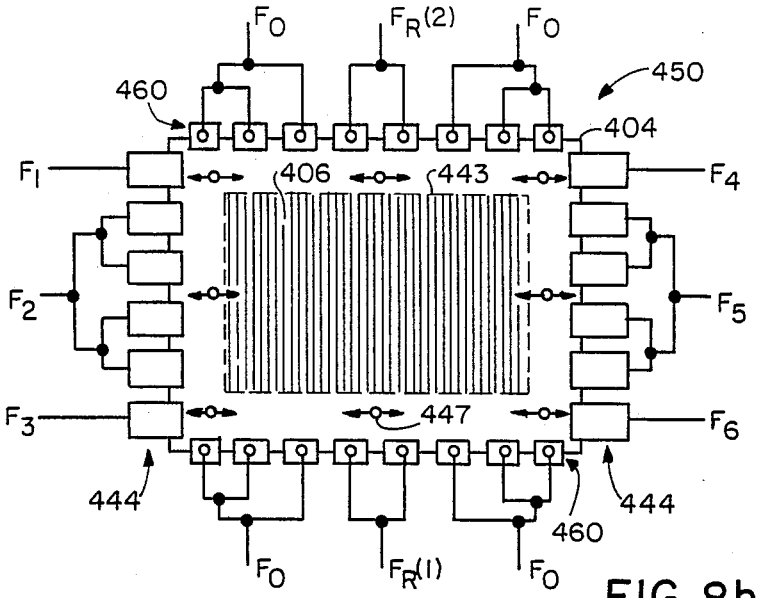
FIGS. 8*b* and 8*c* depict a variant of the FIG. 8*a* embodiment which has provision for the application of tangential forces to the edge of a mask.
Figure 8C:
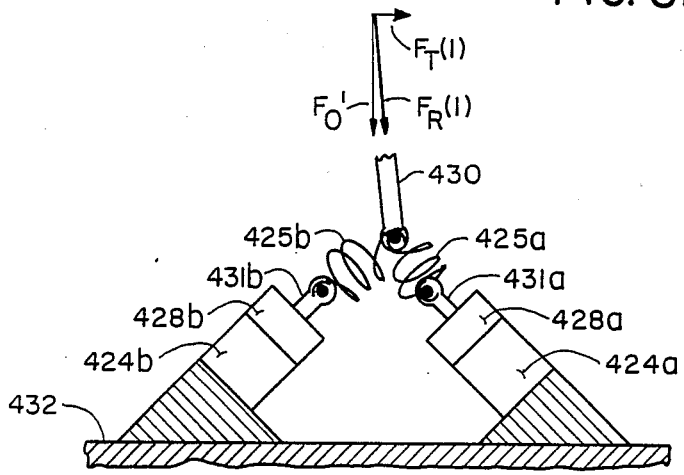

FIG. 8c shows how such a force may be generated. Two stepping motors 424a and 424b are mounted on frame 432 of machine 450 under angles of plus and minus 45 degrees, as indicated. The motors carry reduction gears 428a, 428b, terminating in pull rods 431a and 431b, respectively. A third pull rod 430, linked to the first two pull rods by springs 425a, 425b connects to the lever which drives the two middle clamps. Clamps 460 along the horizontal edges are constructed somewhat differently from clamps 444. They are pivoted as shown so as to permit the application of tangential force components without producing local moments at the edge of the mask.

In operation, the two motors are caused to advance their respective pull rods 431a, 431b, until a predetermined force $F_0'$ is generated on pull rod 430. This force acts at right angles to the edge, and its exact value is not critical.

Assume now that to compensate for a variation in mask thickness, the center portion of the mask needs to be pulled to the right as illustrated by $F_R(1)$ shown in FIG. 8b. To this end, stepping motor 424a is advanced so that its pull rod 431a is pulled closer to the frame. At the same time, motor 424b is backed up so that pull rod 431b is extended beyond its normal position. As a consequence, the lower end of pull rod 430 moves to the right, and a tangential force component $F_T(1)$ is generated. This together with the perpendicular component $F_0'$ produces the desired resultant force $F_R(1)$. Eight position sensors (not depicted) using position sensing apertures 447 are designed to respond solely to positioning errors in x. There are also eight independently controllable forces: $F_1$ through $F_6$, and the two tangential components $F_T(1)$ and $F_T(2)$, of which only the first is shown in FIG. 8c.

The technique described for applying tangential force components to a mask edge is by no means limited to the execution shown in FIG. 8b. A more comprehensive application of the principles described would have provision for applying tangential forces to all clamps. Further, the technique could be applied to masks of other types such as "dot" masks (with round apertures). The technique could be applied to clamps in a non-levered clamping arrangement, as depicted in FIG. 5.

Figure 9:
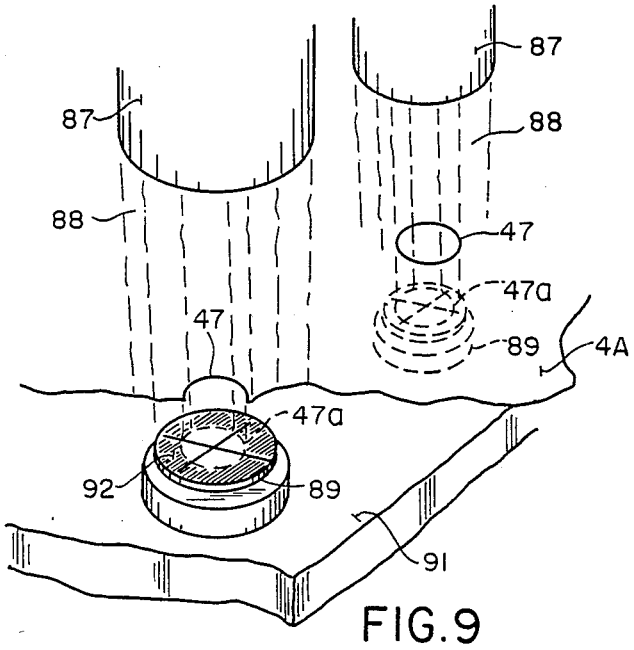
FIGS. 9 and 10 illustrate a quadrant detector optical sensing system for sensing the location of sensing holes in a mask under tension, relative to reference points independent of the mask.

FIG. 9 illustrates the principle of operation of a commercially available quadrant detector optical sensor 89 which may be used in machine 450 to generate the needed positioning error signals. Such a sensor is sold by United Detector Technology of California and consists of a semiconductor chip having a photosensitive region in the shape of a circular disc which is divided into four 90 degree sectors. The photocurrent from each sector is separately available externally.

In FIG. 9, mask 4A is assumed to be in the correct state of tension with the position sensing apertures 47 in registration with optical detection light sensors 89. Each aperture 47 is fully illuminated by a light source 87 emitting a light beam 88. Light beam 88 may be produced by a laser or by a more conventional optical source.

A plurality of quadrant detector light sensors 89 is mounted on a plate 91 whose position with reference to the frame of machine 450 is precisely defined, as described in detail later in connection with FIG. 13. The active area 92 of the quadrant detector light sensor is in vertical alignment with the desired position of position sensing aperture 47. The illuminated area 47a represents the image of aperture hole 47 projected on active surface 92 of quadrant detector light sensor 89.

The diameter of light beam 88 is larger than the diameter of the active area 92 of quadrant detector light sensor 89, while the diameter of position sensing aperture 47 is substantially smaller. If a position sensing aperture is in exact concentric alignment with the active area 92 of its quadrant detector light sensor 89, all four sectors produce the same photocurrent; a matrixing circuit well known in the art, designed to indicate any unbalance between the sector currents, will then indicate zero position error in both x and y coordinates. More specifically, the matrixing circuit provides two outputs. The first indicates the difference between the sum of the two left sector currents and the sum of the two right sector currents; this indicates an error in the x coordinate. The second output indicates the difference between the sum of the two upper sector currents and the sum of the two lower sector currents, thereby signaling an error in the y coordinate.

Figure 10:
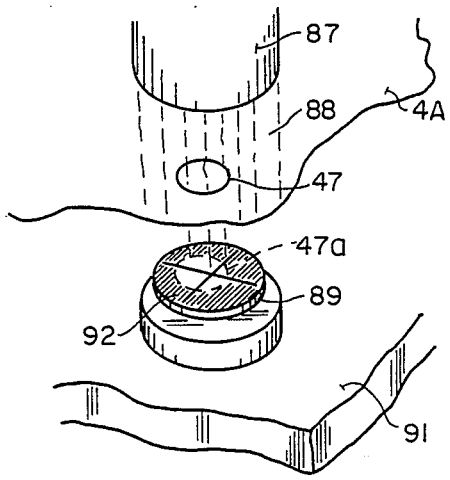

FIG. 10 illustrates a condition where a position sensing aperture 47 is not aligned with the active area 92 of quadrant detector sensor 89; therefore, the projected image 47a is not aligned, the four sectors are unequally illuminated, and a nonzero output signal is generated. In the specific case, the sum of the left sector currents is larger than that of the right sector currents, producing an output in the x coordinate indicating that aperture 47 is too far to the left.

Figure 11:
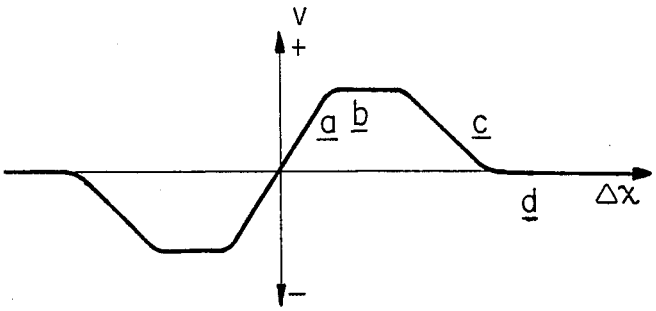
FIG. 11 is a curve showing the output voltage from a matrixing circuit forming part of the quadrant detector optical sensor system.

FIG. 11 indicates the output voltage V from a matrixing circuit of the type described, plotted against the displacement delta x of the aperture. The steep center portion a corresponds to displacements smaller than the radius of position sensing aperture 47. For larger displacements, the output becomes constant (shown at b). Further displacement causes the image of position sensing aperture 47 to cross the edge of active area 92; the output, shown at c, decreases and reaches zero (d) as the image of aperture 47 leaves the active area. The distance between point d and the center of the plot indicates the maximum positioning error which this particular sensor and position sensing aperture combination can read.

Optical detection is by no means the only way of determining position errors. For example, very precise position measurements can be made using a combination of air nozzles, mask apertures and flow or pressure gages.

The position error signals are utilized, as previously explained, to correct any errors in mask position and orientation, to stretch the mask and to adjust its shape. Some of these operations may require certain clamps 44 to back up, i.e. to provide slack so that other clamps can move outward without increasing mask tension. However, the force exerted by each clamp always remains directed outward; backup is achieved by reducing the force exerted by one clamp momentarily below the force of the opposing clamp or clamps.

The required pulling forces may be produced by hydraulic, pneumatic or electric drives. For example, as depicted herein, electric stepping motors, geared down so as to produce large force with small displacement, are well adapted to be driven by computer controlled pulses. To produce an adjustable force rather than a controlled displacement, a spring may be inserted between motor and clamp.

It should be remembered that in practice, one motor may drive a plurality of clamps through a force distributor such as the one depicted in FIG. 7.

According to the invention, computer means are provided for adjusting the force produced by each motor or other force generator. If there were only one motor and one error-sensing means, the feedback loop would be a simple servo and no computation would be needed. The same would be true if each motor influenced only the positioning error of one coordinate in one particular sensor location; a separate loop would then be required for each motor-sensor pair, but there would be no interaction between pairs.

In practice, the situation is more complex; each motor causes displacements at most or all sensor locations. These displacements are largest close to the clamp driven by the particular motor, and much smaller elsewhere, but if there are several or many independent motors, these contributions add up. Each such contribution can be characterized by a matrix coefficient, and for a given configuration of motors, clamps and sensor locations, these coefficients can be determined once and for all, and stored in computer memory. The problem of determining the values of the N forces required to reduce N position errors to zero is then merely that of solving N simultaneous linear equations, a task easily and rapidly performed by a computer.

The clamps used to transmit the controlled forces to the periphery of the mask must be capable of withstanding a pulling force of the order of 30 pounds per inch of width, with a sufficient safety margin. Uncoated steel jaws may be used, in which case clamping forces of several hundred pounds are needed for clamps about one inch wide; elastomeric coatings greatly reduce this requirement but may introduce an element of wear. Hydraulic drives are well adapted to produce the large static force required upon closure. The jaws are preferably held open by relatively weak springs when hydraulic pressure is not applied. During normal operation of machine 450, jaw pressure is applied or released in all clamps at the same time, so that only a single valve is required to apply or remove hydraulic pressure.

Figure 12:
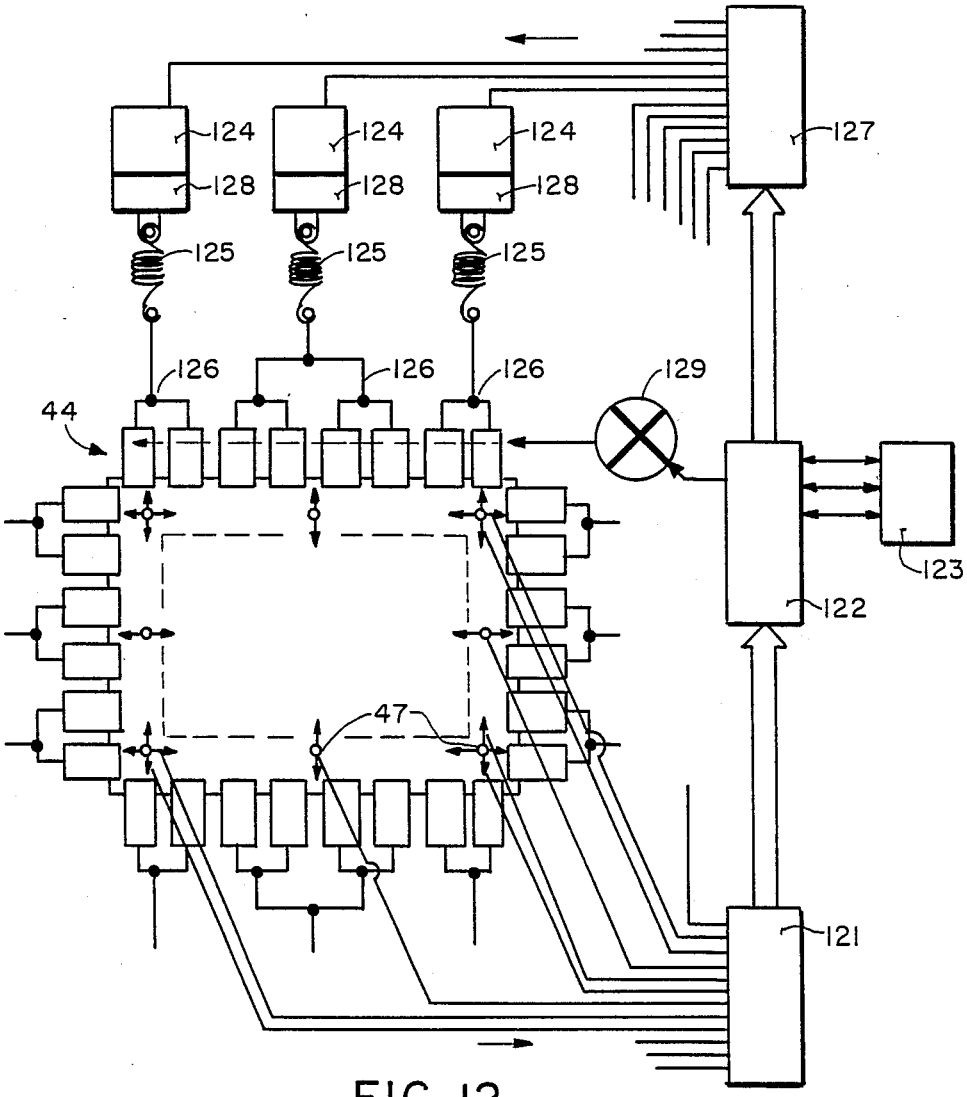
FIG. 12 is a schematic representation of a system employing the principles of the invention, including multiple feedback loops.

FIG. 12 is a schematic representation of the multiple feedback loops above described. Position error signals from position sensing apertures 47 and quadrant detector light sensors 89 are analog signals; they are converted to digital signals in analog/digital converter 121 and are then sent to computer 122. The computer, having the appropriate matrix coefficients stored in its memory 123, calculates the forces to be generated by stepping motors 124 and, based on the known constants of springs 125 and of the force distribution system 126 which transmits the force generated by each motor to several clamps 44, computes the number of steps by which each motor should be advanced or retarded. It also generates the appropriate number and type (forward or backward) of pulses. These pulses are amplified in power amplifiers 127 and applied to the motors 124 which are equipped with reduction gears 128.

The computer also controls the opening and closing of hydraulic valve 129 which applies hydraulic pressure to clamps 44, forcing the jaws to close when the mask is to be clamped and allowing them to open when the mask is to be released.

The arrangement described in connection with FIG. 12 lends itself to the process of bringing the mask into registration with a predetermined standard pattern. FIGS. **13*a*–13*f* illustrate an environment in which this arrangement is used to manufacture mask-panel assemblies for flat tension mask color cathode ray tubes. It is to be understood that the machine 130 depicted in FIGS. 13*a*–13*f* comprises, or operates in connection with, the elements of FIG. 12**.

Figure 13A:
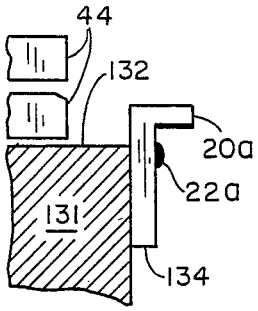
FIGS. 13*a*–13*f* illustrate apparatus and method for carrying out a novel mask mounting process in accordance with the present invention.
Figure 13B:
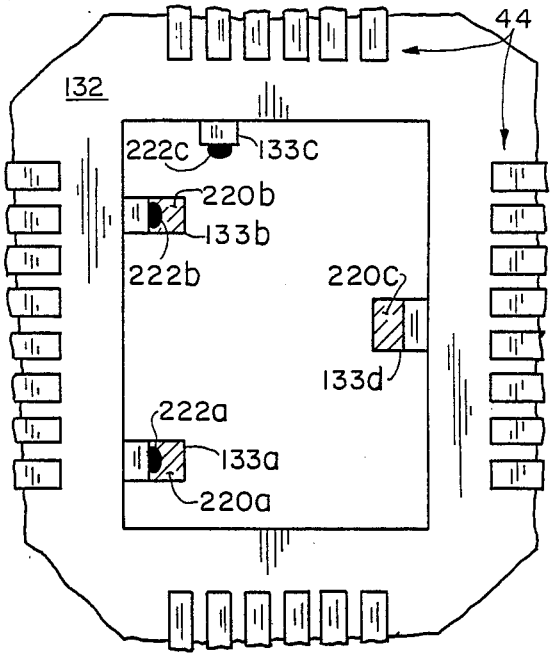
Figure 13C:
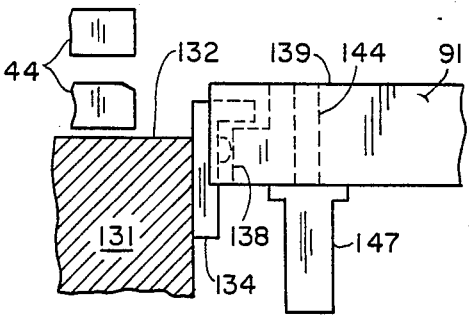

The most important element of machine 130 is a rugged frame 131. One side of this frame is depicted in vertical section in FIG. **13*a*, and a view of the entire inside portion of the frame as seen from below is depicted in FIG. 13*b*. The top of the frame is a flat machined surface 132 on which clamps 44** can slide. The frame forms a window-like opening, somewhat smaller (for example, by one inch about both x and y) than the mask in its original, uncut form.

Four indexing stops **133*a*, 133*b*, 133*c* and 133*d* are shown as being attached to the inside of the frame. The stops 133*a* and 133*b*, placed symmetrically along a common edge, carry half balls 222*a*, 222*b*, as well as vertical stops 220*a*, 220*b*. The half-ball 222*c* is positioned around the corner from 222*b*, but the third vertical stop 220*c* is in the center of the edge opposite the 133A and 133B** stops.

These six indexing elements, together with means (not shown) for pushing a panel upward and sideways to maintain contact at all six points, constitute a form of the six-point universal holding fixture 30 previously described.

A bottom plate 91, seen in section in FIGS. **13*c* and 13*d*, can also be pushed against the same indexing elements. It is large enough to nearly fill the window in frame 131, leaving just a narrow slit all around. It has four cut-out portions 138 to accommodate the six indexing elements, so that bottom plate 91 can be precisely seated. When plate 91 is so seated, its flat top surface 139 is horizontal, parallel to the machined top surface 132 of the frame 131, and coplanar with the top surface of the lower jaws of clamps 44 which rest on surface 132**.

There is also a top plate 141 with a flat horizontal bottom surface 142 which can be brought down from above to set itself against the top surface 139 of bottom plate 91. Both bottom and top plates are equipped with optical devices to be described later.

Instead of the top plate, the welding head 143 of a high-powered laser (See FIG. **13*f*) may be brought down to where its focal point lies in a plane just above the machined top surface 139** of the bottom plate.

In the starting condition of machine 130 shown in FIG. **13*c*, bottom plate 91 is seated against the six indexing elements. Two retractable locating pins (not shown) protrude from top surface 139. Clamps 44 are retracted. A mask 4A is now placed on surface 139**, with appropriate pre-etched apertures to fit the two locating pins.

Next, top plate 141 is lowered until it seats itself against mask 4A. The two protruding locating pins slip into clearance holes (not shown) in the top plate.

Figure 13D:
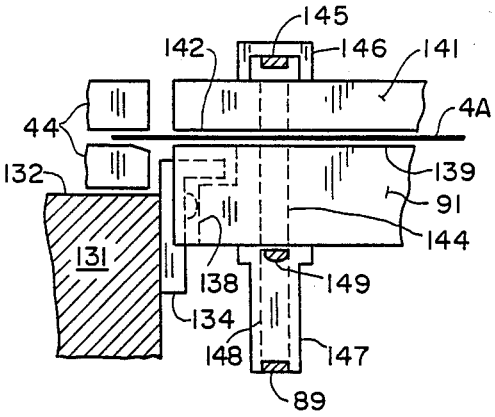

Clamps 44 are advanced until they overlap the mask enough to allow clamping; they are then closed (FIG. 13*d*). Thereupon, the top plate is lifted by a small amount to free the mask, and the two locating pins are retracted.

Corresponding to every position sensing aperture 47 in the mask (not shown in FIGS. 13*a*–13*f*) there is a cylindrical hole 144 in the top and bottom plates. Top plate 141 carries a lamp 145 in a small housing 146 over hole 144. Bottom plate 91, which remains in contact with the mask, carries an optical system 147 consisting of a quadrant detector light sensor 89 at the end of a tube 148, and a lens 149, which serves to focus an image of the mask position sensing aperture 47 upon the quadrant detector light sensor 89. The optical system 147 attached to the bottom of the bottom plate 91 is designed to allow small lateral mechanical adjustments so as to set its position with great accuracy.

Returning now to the operating sequence of machine 130, the feedback system for positioning, stretching and shaping the mask is energized next. Preferably this is done gradually, so as to avoid undesirable mechanical transients. Once all positioning errors are within tolerance, the clamp positions are frozen; for example, if stepping motors are used to pull the clamps, these motors are electrically locked in position.

Figure 13E:
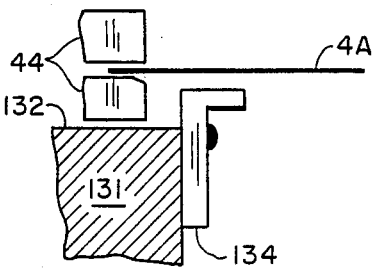
Figure 13F:
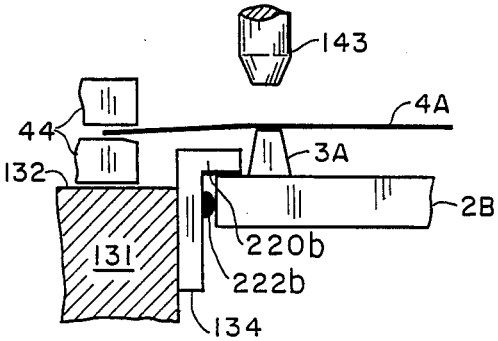

Top and bottom plates are then both withdrawn and moved out of the way (see FIG. 13*e*). A screened panel 2B is inserted into the machine and lifted up against the mask 4A until it is seated against the six indexing elements. At this point, the ground top surface of mask support structure 3A touches the underside of the stretched mask and, preferably, lifts it a few thousandths of an inch. Welding head 143 is now lowered (FIG. 13*f*) and the mask is welded to the support structure. While other ways are available, this may be done in accordance with copending application Ser. No. 058,095 filed June 4, 1987 and assigned to the assignee of this invention.

Next, the peripheral portion of the mask is cut off, preferably using the same laser, and the welding head 143 is lifted and moved out of the way. The clamps 44 are opened and retracted, leaving the cut-off peripheral portion of the mask to be discarded. Finally the completed assembly of panel 2B, and mask 4A—the latter now welded to mask support structure 3A—is lowered and removed from the machine. The two locating pins are once again extended, and the machine is ready for another cycle.

A method according to the invention for use in the manufacture of a color cathode ray tube wherein the shadow masks and front panels are respectively interchangeable, essentially comprises:

providing optical screen reference means associated with a screen pattern on a front panel which is indicative of the size or shape of the screen pattern;

providing optical mask reference means associated with a mask aperture pattern on a shadow mask which is indicative of the size or shape of the mask pattern;

mechanically stretching the mask pattern relative to the screen pattern;

with a feedback system responsive to the mask reference means and the screen reference means and thus to the size or shape relationship of the screen pattern and the mask pattern controlling the mask stretching so that the mask reference means attains optical alignment with the screen reference means indicative of correspondence in size or shape between the mask and screen patterns; and securing the mask to the mask support means on the front panel with the mask and screen patterns in registration.

While particular embodiments of the invention have been shown and described, it will be readily apparent to those skilled in the art that changes and modifications may be made without departing from the invention in its broader aspects; and, therefore, the aim in the appended claims is to cover all such changes and modifications as fall within the true spirit and scope of the invention.

What is claimed is:

1. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, the method comprising:

providing screen reference means associated with a screen pattern on a front panel which is indicative of a geometric parameter of said screen pattern;

providing mask reference means associated with a mask aperture pattern on a shadow mask which is indicative of a corresponding geometric parameter of said mask pattern;

altering the geometric parameter of one of said mask and screen patterns relative to the other; and with a feedback system responsive to said mask reference means and said screen reference means and thus to the said geometrical parameters of said screen pattern and said mask pattern, controlling said altering so that said mask reference means attains a predetermined relationship to said screen reference means.

2. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, the method comprising:

providing screen reference means associated with a screen pattern on a front panel which is indicative of the size or shape of said screen pattern;

providing mask reference means associated with a mask aperture pattern on a shadow mask which is indicative of the size or shape of said mask pattern;

altering the size or shape of one of said patterns relative to the other; and with a feedback system responsive to said mask reference means and said screen reference means and thus to the size or shape relationship of said screen pattern and said mask pattern, controlling said altering so that said mask reference means attains a predetermined relationship to said screen reference means indicative of correspondence in size or shape between said mask and screen patterns.

3. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, the method comprising:

providing optical screen reference means associated with a front panel which is indicative of a geometric parameter of said screen pattern;

providing optical mask reference means on a shadow mask which is indicative of a corresponding geometric parameter of said mask pattern;

altering said geometric parameter of said mask pattern relative to said geometric parameter of said screen pattern;

with a feedback control system responsive to said mask reference means and said screen reference means and thus to the said geometrical parameters of said screen pattern and said mask pattern, controlling said altering so that said mask reference means attains optical alignment with said screen reference means indicative of correspondence between said mask and screen patterns in said geometric parameter.

4. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, the method comprising:

providing optical screen reference means associated with a screen pattern on a front panel which is indicative of the size or shape of said screen pattern;

providing optical mask reference means associated with a mask aperture pattern on a shadow mask which is indicative of the size or shape of said mask pattern;

altering the size or shape of one of said patterns relative to the other; and with a feedback system responsive to said mask reference means and said screen reference means and thus to the size or shape relationship of said screen pattern and said mask pattern, controlling said altering so that said mask reference means attains optical alignment with said screen reference means indicative of correspondence in size or shape between said mask and screen patterns.

5. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, the method comprising:

providing screen reference means associated with a screen pattern on a front panel which is indicative of a geometric parameter of said screen pattern;

providing mask reference means associated with a mask aperture pattern on a shadow mask which is indicative of a corresponding geometric parameter of said mask pattern;

altering said geometric parameter of said mask pattern relative to said geometric parameter of said screen pattern; and with a feedback system responsive to said mask reference means and said screen reference means and thus to said geometric parameters of said screen pattern and said mask pattern, controlling said altering until said mask reference means attains a predetermined relationship to said screen reference means; and securing said mask to said front panel with said mask and screen patterns in registration.

6. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing inner surface of the panel along opposed edges of said screen pattern, wherein the shadow masks and front panels are respectively interchangeable, the method comprising:

providing screen reference means associated with a screen pattern on a front panel which is indicative of the size or shape of said mask pattern;

providing mask reference means associated with a mask aperture pattern on a shadow mask which is indicative of the size or shape of said mask pattern;

altering the size or shape of one of said patterns relative to the other;

with a feedback system responsive to said mask reference means and said screen reference means and thus to said size or shape relationship of said screen pattern and said mask pattern, controlling said alteration so that said mask reference means attains a predetermined relationship to said screen reference means indicative of correspondence in size or shape between said mask and screen patterns; and securing said mask to said mask support means on said front panel with said mask and screen patterns in registration.

7. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing inner surface of the panel along opposed edges of said screen pattern, wherein the shadow masks and front panels are respectively interchangeable, the method comprising:

providing optical screen reference means associated with a front panel which is indicative of a geometric parameter of said screen pattern;

providing optical mask reference means on a shadow mask which is indicative of a corresponding geometric parameter of said mask pattern;

altering said geometric parameter of said mask pattern relative to said geometric parameter of said screen pattern;

with a feedback control system responsive to said mask reference means and said screen reference means and thus to said geometric parameter of said screen pattern and said mask pattern, controlling said altering so that said mask reference means attains optical alignment with said screen reference means indicative of correspondence between said mask and screen patterns in said geometric parameter; and securing said mask to said mask support means on said front panel with said mask and screen patterns in registration.

8. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing inner surface of the panel along opposed edges of said screen pattern, wherein the shadow masks and front panels are respectively interchangeable, the method comprising:

providing optical screen reference means associated with a screen pattern on a front panel which is indicative of the size or shape of said screen pattern;

providing optical mask reference means associated with a mask aperture pattern on a shadow mask which is indicative of the size or shape of said mask pattern;

altering the size or shape of one of said patterns relative to the other;

with a feedback system responsive to said mask reference means and said screen reference means and thus to the size or shape relationship of said screen pattern and said mask pattern, controlling said altering so that said mask reference means attains optical alignment with said screen reference means indicative of correspondence in size or shape between said mask and screen patterns; and securing said mask to said mask support means on said front panel with said mask and screen patterns in registration.

9. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, apparatus comprising:

screen reference means associated with a screen pattern on a front panel and indicative of a geometric parameter of said screen pattern;

mask reference means associated with a mask aperture pattern on a shadow mask and indicative of a corresponding geometric parameter of said mask pattern;

means for altering said geometric parameter of one of said mask and screen patterns relative to the other; and control means including a feedback system responsive to said mask reference means and said screen reference means and thus to said geometrical parameters of said screen pattern and said mask pattern, said control means controlling said altering until said mask reference means attains a predetermined relationship to said screen reference means.

10. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, apparatus comprising:

screen reference means associated with a screen pattern on a front panel and indicative of the size or shape of said screen pattern;

mask reference means associated with a mask aperture pattern on a shadow mask and indicative of the size or shape of said mask pattern;

means for altering the size or shape of one of said patterns relative to the other; and control means including a feedback system responsive to said mask reference means and said screen reference means and thus to said size or shape relationship of said screen pattern and said mask pattern, said control means controlling said mask expansion so that said mask reference means attains a predetermined relationship to said screen reference means indicative of correspondence in said size or shape between said mask and screen patterns.

11. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, apparatus comprising:

optical screen reference means associated with a front panel and indicative of a geometric parameter of said screen pattern;

optical mask reference means on a shadow mask and indicative of a corresponding geometric parameter of said mask pattern;

means for altering one of said parameters relative to the other; and control means including a feedback system responsive to said mask reference means and said screen reference means and thus to said geometrical parameters of said screen pattern and said mask pattern, said control means controlling said altering so that said mask reference means attains optical alignment with said screen reference means indicative of correspondence between said mask and screen patterns in said geometric parameter.

12. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, apparatus comprising:

optical screen reference means associated with a screen pattern on a front panel and indicative of the size or shape of said screen pattern;

optical mask reference means associated with a mask aperture pattern on a shadow mask and indicative of the size or shape of said mask pattern;

means for altering the size or shape of one of said patterns relative to the other; and control means including a feedback system responsive to said mask reference means and said screen reference means and thus the size or shape relationship of said screen pattern and said mask pattern, said control means for controlling said alteration so that said mask reference means attains optical alignment with said screen reference means indicative of correspondence in size or shape between said mask and screen patterns in said geometric parameter.

13. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, apparatus comprising:

screen reference means associated with a screen pattern on a front panel and indicative of a geometric parameter of said screen pattern;

mask reference means associated with a mask aperture pattern on a shadow mask and indicative of a corresponding geometric parameter of said mask pattern;

means for altering one of said geometric parameters relative to the other; and control means including a feedback system responsive to said mask reference means and said screen reference means and thus to said geometrical parameters of said screen pattern and said mask pattern, said control means controlling said altering so that said mask reference means attains a predetermined relationship to said screen reference means; and means for securing said mask to said front panel with said mask and screen patterns in registration.

14. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing surface of the panel along opposed edges of said screen pattern, wherein the shadow masks and front panels are respectively interchangeable, apparatus comprising:

screen reference means associated with a screen pattern on a front panel and indicative of the size or shape of said screen pattern;

mask reference means associated with a mask aperture pattern on a shadow mask and indicative of the size or shape of said mask pattern;

means for altering the size or shape of one of said patterns relative to the other;

control means including a feedback system responsive to said mask reference means and said screen reference means and thus to said size or shape relationship of said screen pattern and said mask pattern, said control means controlling said mask alteration so that said mask reference means attains a predetermined relationship to said screen reference means indicative of correspondence in said size or shape between said mask and screen patterns; and means for securing said mask to said mask support means on said front panel with said mask and screen patterns in registration.

15. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing inner surface of the panel along opposed edges of said screen pattern, wherein the shadow masks and front panels are respectively interchangeable, apparatus comprising:

optical screen reference means associated with a front panel and indicative of a geometric parameter of said screen pattern;

optical mask reference means on a shadow mask and indicative of a corresponding geometric parameter of said mask pattern;

means for altering one of said geometric parameters relative to the other;

control means including a feedback system responsive to said mask reference means and said screen reference means and thus to said geometrical parameters of said screen pattern and said mask pattern, said control means controlling said altering so that said mask reference means attains optical alignment with said screen reference means indicative of correspondence between said mask and screen patterns in said geometric parameter; and means for securing said mask to said mask support means on said front panel with said mask and screen patterns in registration.

16. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing inner surface of the panel along opposed edges of said screen pattern, wherein the shadow masks and front panels are respectively interchangeable, apparatus comprising:

optical screen reference means associated with a screen pattern on a front panel and indicative of the size or shape of said screen pattern;

optical mask reference means associated with a mask aperture pattern on a shadow mask and indicative of the size or shape of said mask pattern;

means for altering the size or shape of one of said patterns relative to the other;

control means including a feedback system responsive to said mask reference means and said screen reference means and thus the size or shape relationship of said screen pattern and said mask pattern, said control means for controlling said expansion so that said mask reference means attains optical alignment with said screen reference means indicative of correspondence in size or shape between said mask and screen patterns in said geometric parameter; and means for securing said mask to said mask support means on said front panel with said mask and screen patterns in registration.

17. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow mask and front panels are respectively interchangeable, the method comprising:

providing screen reference means associated with a screen pattern on a front panel which is indicative of a geometric parameter of said screen pattern;

providing mask reference means associated with a mask aperture pattern on a shadow mask which is indicative of a corresponding geometric parameter of said mask pattern;

mechanically stretching a mask to alter said geometric parameter of said mask pattern relative to that of said screen pattern; and controlling said stretching so that said mask reference means attains a predetermined relationship to said screen reference means.

18. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow mask and front panels are respectively interchangeable, the method comprising:

providing screen reference means associated with a screen pattern on a front panel which is indicative of a geometric parameter of said screen pattern;

providing mask reference means associated with a mask aperture pattern on a shadow mask which is indicative of a corresponding geometric parameter of said mask pattern;

mechanically stretching a mask to alter said geometric parameter of said mask pattern relative to that of said screen pattern; and with a feedback system responsive to said mask reference means and said screen reference means and thus to the said geometrical parameter of said screen pattern and said mask pattern, controlling said stretching so that said mask reference means attains a predetermined relationship to said screen reference means.

19. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, the method comprising:

providing screen reference means associated with a screen pattern on a front panel which is indicative of the size or shape of said screen pattern;

providing mask reference means associated with a mask aperture pattern on a shadow mask which is indicative of the size or shape of said mask pattern;

mechanically stretching said mask pattern relative to said screen pattern; and with a system responsive to said mask reference means and said screen reference means and thus to the size or shape relationship of said screen pattern and said mask pattern, controlling said mask stretching so that said mask reference means attains a predetermined relationship to said screen reference means indicative of correspondence in size or shape between said mask and screen patterns.

20. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, the method comprising:

providing optical screen reference means associated with a screen pattern on a front panel which is indicative of the size and shape of said screen pattern;

providing optical mask reference means associated with a mask aperture pattern on a shadow mask which is indicative of the size and shape of said mask pattern;

mechanically stretching said mask pattern relative to said screen pattern; and with a feedback system responsive to said mask reference means and said screen reference means and thus to the size and shape relationship of said screen pattern and said mask pattern, controlling said mask stretching so that said mask reference means attains optical alignment with said screen reference means indicative of correspondence in size and shape between said mask and screen patterns.

21. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing inner surface of the panel along opposed edges of said screen pattern, wherein the shadow masks and front panels are respectively interchangeable, the method comprising:

providing screen reference means associated with a screen pattern on a front panel which is indicative of the size or shape of said screen pattern;

providing mask reference means associated with a mask aperture pattern on a shadow mask which is indicative of the size or shape of said mask pattern;

mechanically stretching said mask pattern relative to said screen pattern;

controlling said mask stretching so that said mask reference means attains a predetermined relationship to said screen reference means indicative of correspondence in size or shape between said mask and screen patterns; and securing said mask to said mask support means on said front panel with said mask and screen patterns in registration.

22. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing inner surface of the panel along opposed edges of said screen pattern, wherein the shadow masks and front panels are respectively interchangeable, the method comprising:

providing optical screen reference means associated with a screen pattern on a front panel which is indicative of the size or shape of said screen pattern;

providing optical mask reference means associated with a mask aperture pattern on a shadow mask which is indicative of the size or shape of said mask pattern;

mechanically stretching said mask pattern relative to said screen pattern;

with a feedback system responsive to said mask reference means and said screen reference means and thus to the size or shape relationship of said screen pattern and said mask pattern controlling said mask stretching so that said mask reference means attains optical alignment with said screen reference means indicative of correspondence in size or shape between said mask and screen patterns; and securing said mask to said mask support means on said front panel with said mask and screen patterns in registration.

23. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, apparatus comprising:

screen reference means associated with a screen pattern on a front panel and indicative of a geometric parameter of said screen pattern;

mask reference means associated with a mask aperture pattern on a shadow mask and indicative of a corresponding geometric parameter of said mask pattern;

means for mechanically stretching a mask to alter said geometric parameter of said mask pattern relative to that of said screen pattern; and control means for controlling said stretching so that said mask reference means attains a predetermined relationship to said screen reference means.

24. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, apparatus comprising:

screen reference means associated with a screen pattern on a front panel and indicative of the size and shape of said screen pattern;

mask reference means associated with a mask aperture pattern on a shadow mask and indicative of the size and shape of said mask pattern;

means for mechanically stretching said mask pattern relative to that of said screen pattern; and control means including a feedback system responsive to said mask reference means and said screen reference means and thus to said size and shape relationship of said screen pattern and said mask pattern, said control means controlling said mask stretching so that said mask reference means attains a predetermined relationship to said screen reference means indicative of correspondence in said size and shape between said mask and screen patterns.

25. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, apparatus comprising:

optical screen reference means associated with a screen pattern on a front panel and indicative of the size or shape of said screen pattern;

optical mask reference means associated with a mask aperture pattern on a shadow mask and indicative of the size or shape of said mask pattern;

means for mechanically stretching said mask pattern relative to that of said screen pattern; and control means including a feedback system responsive to said mask reference means and said screen reference means and thus the size or shape relationship of said screen pattern and said mask pattern, said control means for controlling said stretching so that said mask reference means attains optical alignment with said screen reference means indicative of correspondence in size or shape between said mask and screen patterns in said geometric parameter.

26. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, wherein the shadow masks and front panels are respectively interchangeable, apparatus comprising:

optical screen reference means associated with a screen pattern on a front panel and indicative of the size or shape of said screen pattern;

optical mask reference means associated with a mask aperture pattern on a shadow mask and indicative of the size or shape of said mask pattern;

means for mechanically stretching said mask pattern relative to that of said screen pattern; and control means including a feedback system responsive to said mask reference means and said screen reference means and thus to the size or shape relationship of said screen pattern and said mask pattern, said control means for controlling said stretching until said mask reference means attains optical alignment with said screen reference means indicative of correspondence in size or shape between said mask and screen patterns in said geometric parameter.

27. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing inner surface of the panel along opposed edges of said screen pattern, wherein the shadow masks and front panels are respectively interchangeable, apparatus comprising:

optical screen reference means associated with a screen pattern on a front panel and indicative of the size and shape of said screen pattern;

optical mask reference means associated with a mask aperture pattern on a shadow mask and indicative of the size or shape of said mask pattern;

means for mechanically stretching said mask pattern relative to that of said screen pattern;

control means including a feedback system responsive to said mask reference means and said screen reference means and thus the size and shape relationship of said screen pattern and said mask pattern, said control means controlling said stretching so that said mask reference means attains optical alignment with said screen reference means indicative of correspondence in size and shape between said mask and screen patterns in said geometric parameter; and means for securing said mask to said mask support means on said front panel with said mask and screen patterns in registration.

28. For use in the manufacture of a color cathode ray tube having a shadow mask with a central pattern of apertures mounted in tension on a transparent flat front panel with the mask aperture pattern in registration with a corresponding cathodoluminescent screen pattern on an inner surface of the panel, said front panel having mask support means secured to the screen-bearing inner surface of the panel along opposed edges of said screen pattern, wherein the shadow masks and front panels are respectively interchangeable, apparatus comprising:

optical screen reference means associated with a screen pattern on a front panel and indicative of the size and shape of said screen pattern;

optical mask reference means associated with a mask aperture pattern on a shadow mask and indicative of the size or shape of said mask pattern;

means for mechanically stretching said mask pattern relative to said screen pattern;

control means including a feedback system responsive to said mask reference means and said screen reference means and thus the size and shape relationship of said screen pattern and said mask pattern, said control means controlling said stretching so that said mask reference means attains optical alignment with said screen reference means indicative of correspondence in size and shape between said mask and screen patterns in said geometric parameter; and means for securing said mask to said mask support means on said front panel with said mask and screen patterns in registration.

29. For use in a manufacturing process for color cathode ray tubes of the flat tension mask type wherein shadow masks and front panels are respectively interchangeable during mask-panel assembly, the method comprising:

providing a shadow mask having a predetermined pattern of apertures; and mechanically stretching the mask to establish correspondence between geometrical reference points on the mask and geometrical reference points associated with a previously fabricated screen pattern on a front panel.

30. For use in a manufacturing process for color cathode ray tubes of the flat tension mask type wherein shadow masks and front panels are respectively interchangeable during mask-panel assembly, the method comprising:

providing a shadow mask having a predetermined pattern of apertures;

providing a front panel having a cathodoluminesent screen pattern and integral mask support means along opposed edges of said screen pattern;

mechanically stretching the mask to establish correspondence between geometrical reference points on the mask and an external geometrical reference; and affixing the mask to said mask support means with said mask in tension and said pattern of apertures in registration with the screen pattern.

31. For use in a manufacturing process for color cathode ray tubes of the flat tension mask type wherein shadow masks and front panels are respectively interchangeable during mask-panel assembly, the method comprising:

providing a shadow mask having a predetermined pattern of apertures;

sensing a difference in the size or shape of the mask relative to a predetermined reference, and producing an error signal corresponding to said difference; and applying to said mask tensile forces controlled by a feedback system responsive to said error signal to change the size or shape of said mask to reduce said difference toward zero.

32. For use in a manufacturing process for color cathode ray tubes of the flat tension mask type wherein shadow masks and front panels are respectively interchangeable during mask-panel assembly, the method comprising:

providing a shadow mask having a predetermined pattern of apertures;

providing a front panel having a cathodoluminescent screen pattern located with respect to a predetermined first reference and integral mask support means along opposed edges of said screen pattern;

mechanically stretching the mask to establish correspondence between geometrical reference points on the mask and an external second geometrical reference associated with a previously fabricated screen pattern on a front panel.

33. For use in a manufacturing process for color cathode ray tubes of the flat tension mask type wherein shadow masks and front panels are respectively interchangeable during mask-panel assembly, the method comprising:

providing a shadow mask having a predetermined pattern of apertures;

sensing a difference in the size or shape of the mask relative to a predetermined reference; and acting on said mask in a controlled manner to change the size or shape of the mask, including applying tensile forces to said mask, to reduce the said difference toward zero.

34. For use in a manufacturing process for color cathode ray tubes of the flat tension mask type wherein shadow masks and front panels are respectively interchangeable during mask-panel assembly, the method comprising:

applying to the panel a screen pattern bearing a predetermined geometrical relationship to a predetermined first reference;

stretching a mask to change the size or shape thereof so as to establish a predetermined geometrical relationship of a pattern of apertures in the mask to the same or an equivalent reference; and attaching the mask to a mask support structure on the panel while said panel and mask are referenced to the same or an equivalent reference to thereby establish a desired geometrical relationship between the screen pattern and said pattern of apertures in the mask.

35. For use in a manufacturing process for color cathode ray tubes of the flat tension mask type wherein shadow masks and front panels are respectively interchangeable during mask-panel assembly, the method comprising:

providing a shadow mask having a predetermined pattern of apertures;

providing a front panel having a cathodoluminescent screen pattern located with respect to a predetermined first reference and integral mask support means along opposed edges of said screen pattern;

sensing a difference in the size or shape of the mask relative to a predetermined reference and producing an error signal corresponding to said difference;

applying to said mask tensile forces controlled by a feedback system responsive to said error signal to change the size or shape of said mask to establish correspondence between geometrical reference points on the mask and an external second geometrical reference; and affixing the mask to said mask support means with said mask in tension, using said first and second references, to establish registration between said mask and screen patterns.

* * * * *